US008020628B2

(12) United States Patent
Fabre et al.

(10) Patent No.: US 8,020,628 B2
(45) Date of Patent: Sep. 20, 2011

(54) FIRE EXTINGUISHING DEVICE

(75) Inventors: Christian Fabre, Tournefeuille (FR); Christophe Bourdet, Roinville Sous Dourdan (FR); Philippe Mangon, Elancourt (FR)

(73) Assignee: Airbus Operations SAS, Toulouse (FR)

( * ) Notice: Subject to any disclaimer, the term of this patent is extended or adjusted under 35 U.S.C. 154(b) by 1746 days.

(21) Appl. No.: 11/029,378

(22) Filed: Jan. 6, 2005

(65) Prior Publication Data

US 2005/0150663 A1 Jul. 14, 2005

(30) Foreign Application Priority Data

Jan. 9, 2004 (FR) ..... 04 50058

(51) Int. Cl.
*A62C 35/00* (2006.01)
*A62C 35/02* (2006.01)

(52) U.S. Cl. ..... 169/8; 169/5; 169/14; 169/15; 169/27

(58) Field of Classification Search ..... 169/13, 169/71, 77, 85, 6–9; 137/501
See application file for complete search history.

(56) References Cited

U.S. PATENT DOCUMENTS 3,965,988 A * 6/1976 Wesson et al. ..... 169/9
3,977,474 A * 8/1976 Boegli ..... 169/9
4,877,051 A 10/1989 Day
6,112,822 A * 9/2000 Robin et al. ..... 169/46
6,276,459 B1 * 8/2001 Herrick et al. ..... 169/14

FOREIGN PATENT DOCUMENTS

| | | | |
|---|---|---|---|
| EP | 1 142 611 | A1 | 10/2001 |
| FR | 2 421 632 | | 11/1979 |
| GB | 2 028 127 | A | 3/1980 |
| GB | 2 317 824 | A | 4/1998 |
| WO | WO 93/25950 | | 12/1993 |
| WO | WO 96/23550 | | 8/1996 |
| WO | WO 98/02211 | | 1/1998 |
| WO | WO 01/78841 | A2 | 10/2001 |
| WO | WO 01/93956 | A1 | 12/2001 |

OTHER PUBLICATIONS

U.S. Appl. No. 11/132,395, filed May 19, 2005, Fabre.
U.S. Appl. No. 11/720,665, filed Jun. 1, 2007, Fabre.
Commercial notice for bürkert Easy Fluid Control Systems, "Paddle-Wheel Flow Sensor/Switch for Easy On/Office Control", Jan. 1997, 2 pages.

* cited by examiner

*Primary Examiner* — Len Tran
*Assistant Examiner* — James Hogan
(74) *Attorney, Agent, or Firm* — Oblon, Spivak, McClelland, Maier & Neustadt, L.L.P.

(57) ABSTRACT

A fire extinguishing device comprises an extinguishing agent tank and pressurised gas generation means such that the generated gas can enter into the tank when the extinguishing agent is to be ejected on a fire area.
The device according to the invention also comprises means of regulating the pressure inside the extinguishing agent tank: thus, the pressure inside the tank remains controlled with time, with a profile predetermined by the user as a function of regulatory parameters and criteria, in order to optimise the action of the extinguishing agent and the necessary quantity.

28 Claims, 6 Drawing Sheets

FIG. 6A
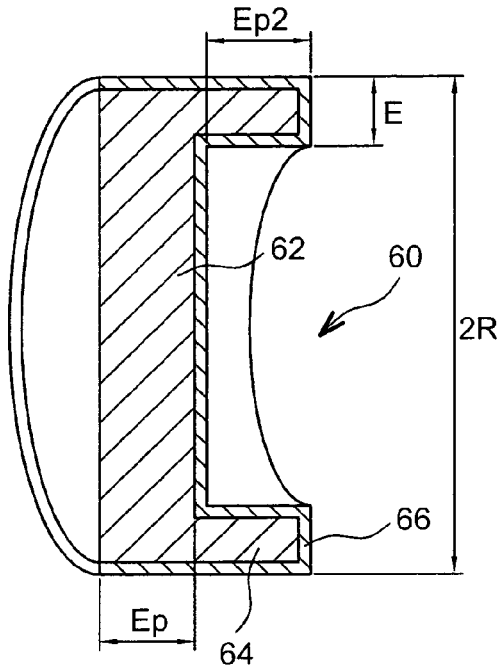
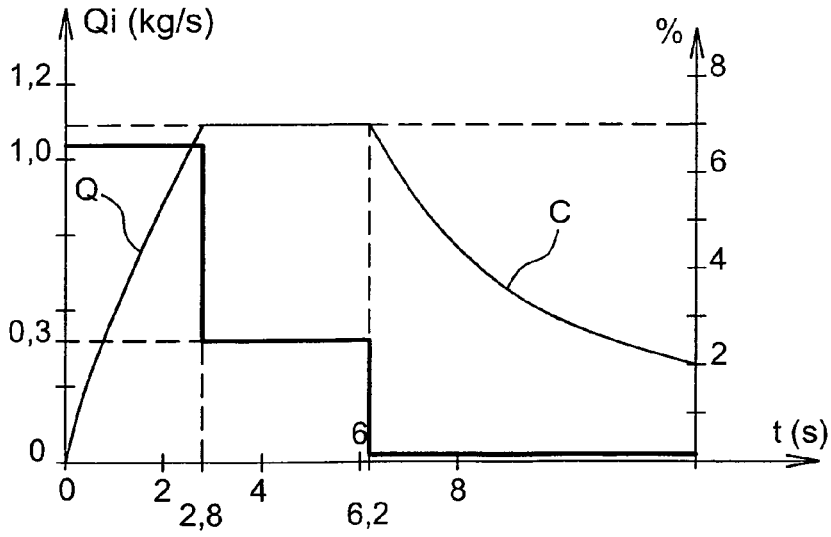
FIG. 6B

FIG. 7A
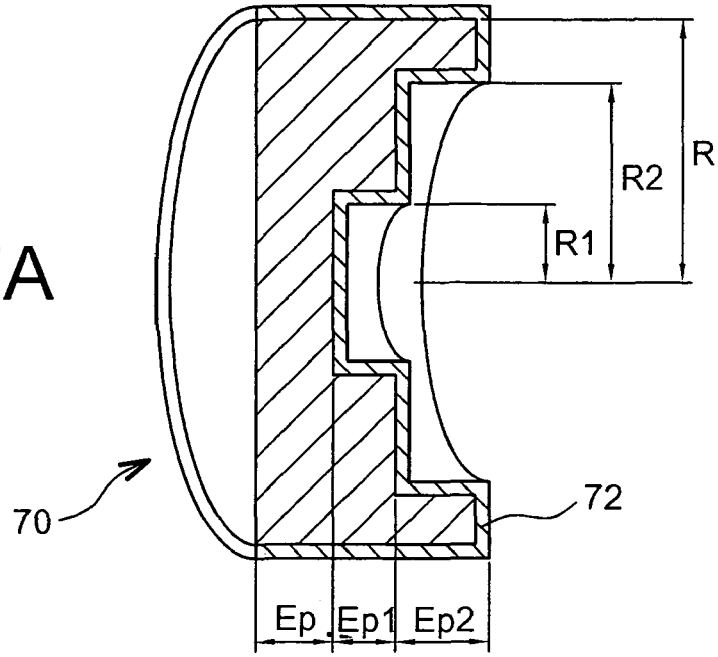
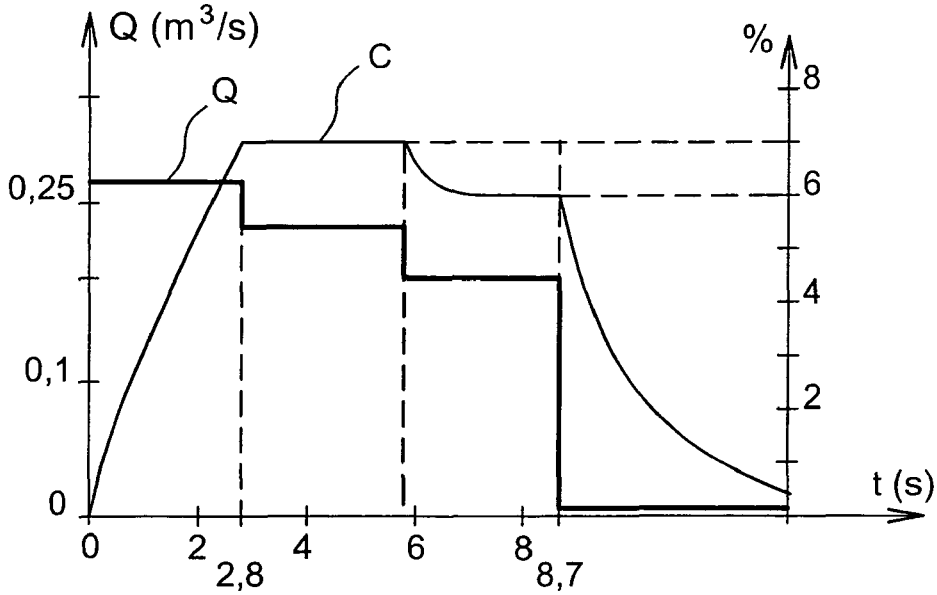
FIG. 7B

FIRE EXTINGUISHING DEVICE

TECHNICAL FIELD

The invention relates to fire fighting devices, also called extinguishers. In particular, the invention is used in applications for fire extinguishing devices at fixed position that can be triggered remotely, in which the extinguishing agent stored in a tank is expelled at the time of use.

The invention is applicable particularly to a device for controlled pressurisation of the tank containing the extinguishing agent.

STATE OF PRIOR ART

It is known that extinguishers with an extinguishing agent tank are classified into two, main categories. The first category relates to permanent pressure devices in which a gas provides permanent pressurisation of the extinguishing agent within a single bottle that it uses as a tank; the extinguishing agent is released by a valve at the outlet from said bottle. In the second category, a propulsion gas is only released when the extinguisher is put into service and releases the extinguishing agent, which is therefore not stored under pressure.

Extinguishers currently used to extinguish an aircraft engine fire could be used as an example of the first type of extinguisher. These devices use halon as the extinguishing agent, and firstly extinguish fire, and also prevent any extension to said fire.

The extinguishing agent is contained in a bottle, usually spherical in shape, pressurised by an inert gas; two or more extinguishers may be installed, depending on safety requirements. One or several distribution pipes connected to said bottle can be used for distribution of the extinguishing agent towards the areas to be protected. A calibrated shutter at the bottom end of the bottle can close off each distribution pipe. A pressure sensor is also installed to continuously check the pressurisation of the bottle. A pyrotechnic detonator is triggered when a fire is detected. The resulting wave shock penetrates the closing shutter, which causes the bottle to be emptied and the extinguishing agent is forced out under the effect of the pressure inside the bottle through the pipes towards areas to be protected.

A first disadvantage of this type of pressurised extinguishers is their sensitivity to micro-leaks, which is why they have to be subjected to severe monitoring, verification and maintenance conditions.

Furthermore, the regulations impose constraints requiring minimum durations and concentrations sufficient to guarantee fire extinction. The concentration C(t) obtained in an area depends particularly on the flow $Q_i$ of extinguishing agent injected into said area, the volume V of said area, the arrangement of the ejection means and the ventilation of the area, in other words the flow $Q_r$ of renewal air. For example, in the case in which renewal air does not contain any extinguishing agent and in which only the extinguishing agent reaches the area of the fire through a pipe, the following equation is obtained (k constant):

$$C(t) = k.\exp\left(-\left(\frac{Q_r + Q_i}{V}\right)t\right) + \frac{Q_i}{Q_r + Q_i} \quad (1)$$

For example, in aeronautical applications, the criterion imposed at the present time for the special case of halon extinguishers is that the concentration of halon in all burning areas of the engine is at least 6% simultaneously for a minimum time of 0.5 seconds. As soon as the closing shutter is perforated, the extinguishing agent forced out by the pressurised gas will flow through the distribution pipes as far as the engine fire areas. The pressure in the bottle drops quickly, so that the concentration of the extinguishing agent follows a bell-shaped curve.

In FIG. 1, the five curves represent the variation of the concentration of halon during discharge for five measurement points; the three discharge steps can be seen, namely setting up initial conditions (a), the maximum concentration (b) and then the drop in the concentration (c) following the pressure drop in the bottle until it is completely empty. Constraints imposed by regulations in force (d) are shown in this Figure; the concentration of extinguishing gas for all burning areas of the engine must be greater than 6% for a minimum time of 0.5 seconds. Only one fire area is shown in this Figure, but the criterion defined in the regulations is applicable to simultaneous action in all areas of the fire. Therefore, it can be seen that respecting this regulation criterion (d) makes it necessary to reach local concentration peaks much greater than the minimum imposed concentration (from 50% to 100% higher), without necessarily significantly increasing the extinguishing efficiency. Therefore the result is an additional disadvantage, namely that the quantity of extinguishing agent has to be greater than is strictly necessary.

Finally, the extinguishing agent does not completely fill the bottle since the bottle has to contain the pressurisation gas.

Extinguishers in the second category use a separate pressurisation device. These fire fighting devices are usually equipped with a first compressed gas tank and a second tank for the extinguishing agent. When the apparatus is used, the compressed gas contained in the first tank is put into communication with the second extinguishing agent tank through an orifice, to pressurise the bottle containing the extinguishing agent. When the extinguishing agent is pressurised, it is ejected to fight the fire in the same way as for equipment in the first extinguisher category. In fact, it should be noted that once the propulsion gas has been released, the second category of extinguisher is exactly the same as the first category and therefore has the same disadvantages.

In some cases, for generators in the second category, the first compressed gas tank may be replaced by a gas generator as described in document WO 98/02211. However, the reaction time necessary between when the extinguisher is triggered and when the extinguishing agent is ejected is unacceptable for some types of fire, or suspected fire, for example in aeronautical applications. Furthermore, the problem of controlling the concentration of extinguishing agent in the area to be protected is not solved.

SUMMARY OF THE INVENTION

The purpose of the invention is to overcome the disadvantages of fire extinguishers mentioned above, particularly in aircraft engines, among other advantages.

According to one of its aspects, the invention relates to a fire extinguishing device in which the extinguishing agent is flushed from the tank in which it is stored by a pressurised gas, the pressurised gas being brought and held in said tank in a regulated manner. Since the pressure in the tank follows a predetermined profile as a function of time, it is possible to obtain a concentration of extinguishing agent in the area to be treated as close as possible to a required concentration law.

Advantageously, the extinguishing device according to the invention comprises a tank in which the extinguishing agent is stored, said tank being connected firstly to an extinguishing agent distribution network leading to areas to be treated, preferably close to a storage point of said agent, and secondly to a pressurised gas generation means, usually but not necessarily at a point approximately opposite the storage point mentioned above.

Means of closing off the tank containing the extinguishing agent prevent the extinguishing agent from flowing in the distribution network when there is no pressure in said tank. Said closing means may consist of a valve whose opening is controlled during the extinguisher trigger sequence, either following an external order, or pressurisation of the tank. They may also consist of a sealed shutter rated so as to break under pressure when the tank reaches this pressure.

Depending on the geometry of the distribution network, the dimensions and ventilation of the areas to be treated, those skilled in the art will determine the pressure to be applied in the tank containing the extinguishing agent such that the flow of extinguishing agent results in the required concentration in the area to be treated (taking account of pressure losses, geometry of areas to be treated, etc.), through calculations that could be refined during experiments. The parameters can be used for selection and/or configuration of the regulation means.

Pressure regulation means in the tank limit the output flow of the extinguishing agent to the required value, that can vary according to a profile defined with time, without an unnecessarily excessive quantity of extinguishing agent being sent to areas to be treated; it is thus possible to treat an area for longer and more efficiently with a given quantity of agent, or to use a smaller quantity of agent while guaranteeing the concentration of the extinguishing agent during a determined time. In particular, the regulation means may be chosen and/or configured so as to obtain a "step" pressure profile in which the pressure in the tank is approximately constant for a given time, in other words it varies between two very similar values. In particular, the real pressure does not vary from the nominal value by more than 10%, and preferably not more than 5%. Successive plateau may also be chosen for the profile. The regulation time is chosen as a function of use, for example to be more than or equal to 2 s or 5 s.

A measure of the concentration of extinguishing agent in the areas to be treated may enable a more precise closed loop regulation of the gas pressure in the tank.

According to one embodiment, the means of generating the pressurised gas may include a pressurised gas storage; the pressurised gas is stored in a separate bottle, connected to said extinguishing agent tank, for example through a communication pipe. The pressure regulation means may consist of flow regulation or pressure regulation valves that may be controlled between complete closing of the communication means between the pressurised gas bottle and the extinguishing agent tank, until maximum opening. Advantageously, the regulation valves are controlled according to a given law defined by the user, possibly using information originating from extinguishing agent concentration sensors (closed loop or open loop regulation depending on the case). Regulation may also be achieved by other regulation devices such as a pressure reducer that may or may not be associated with a device that creates a pressure difference (diaphragm, nozzle).

Gas capacities (volume and pressure) of the pressurised bottle can be determined such that the pressure expected at any instant in the extinguishing agent tank is achieved until said agent is completely expelled into the area to be treated. The capacity of the pressurised gas bottle can also advantageously take account of the effects of micro-leaks so that these micro-leaks have no consequences on the operational capabilities of a device according to the invention, at least between two periodic inspections. In this embodiment, said gas can also be stored in pressurised form in two or several bottles connected to said extinguishing agent tank through pressure regulation means, either with one pressure regulation means like a regulator, for each bottle, or through a smaller number by grouping several bottles onto the same pressure regulation means, e.g. a valve.

According to another embodiment, the gas that pressurises said extinguishing agent tank is generated at the time that the extinguisher is used by combustion of a block of pyrotechnic material; the generation means may consist of a gas generator. In this case, the geometry of the block of pyrotechnic material can be used to generate combustion gases according to a predetermined law as a function of the required use in the same way as for powder propulsion systems. Once triggered, combustion of the block of pyrotechnic material no longer needs to be controlled; the regulation means being composed of the geometry of the gas generator and the reaction initiation mechanism. However, a valve may also be present.

According to one aspect of the invention, the extinguishing device may be triggered by a remote operator. It may also be controlled directly by a device receiving information from a sensor which will detect conditions related to the probability of a fire.

The device may be equipped with a neutralisation device to prevent unwanted tripping, particularly during maintenance operations.

BRIEF DESCRIPTION OF THE FIGURES

The Figures in the appended drawings will enable a better understanding of the invention, but they are only given for guidance and are in no way restrictive.

FIGS. 6A and 6B show an example of the geometry of the propellant block and associated concentration and gas flow profiles.

FIGS. 7A and 7B show another example of the geometry of the propellant block and associated profiles.

DETAILED DISCLOSURE OF PARTICULAR EMBODIMENTS

Figure 1:
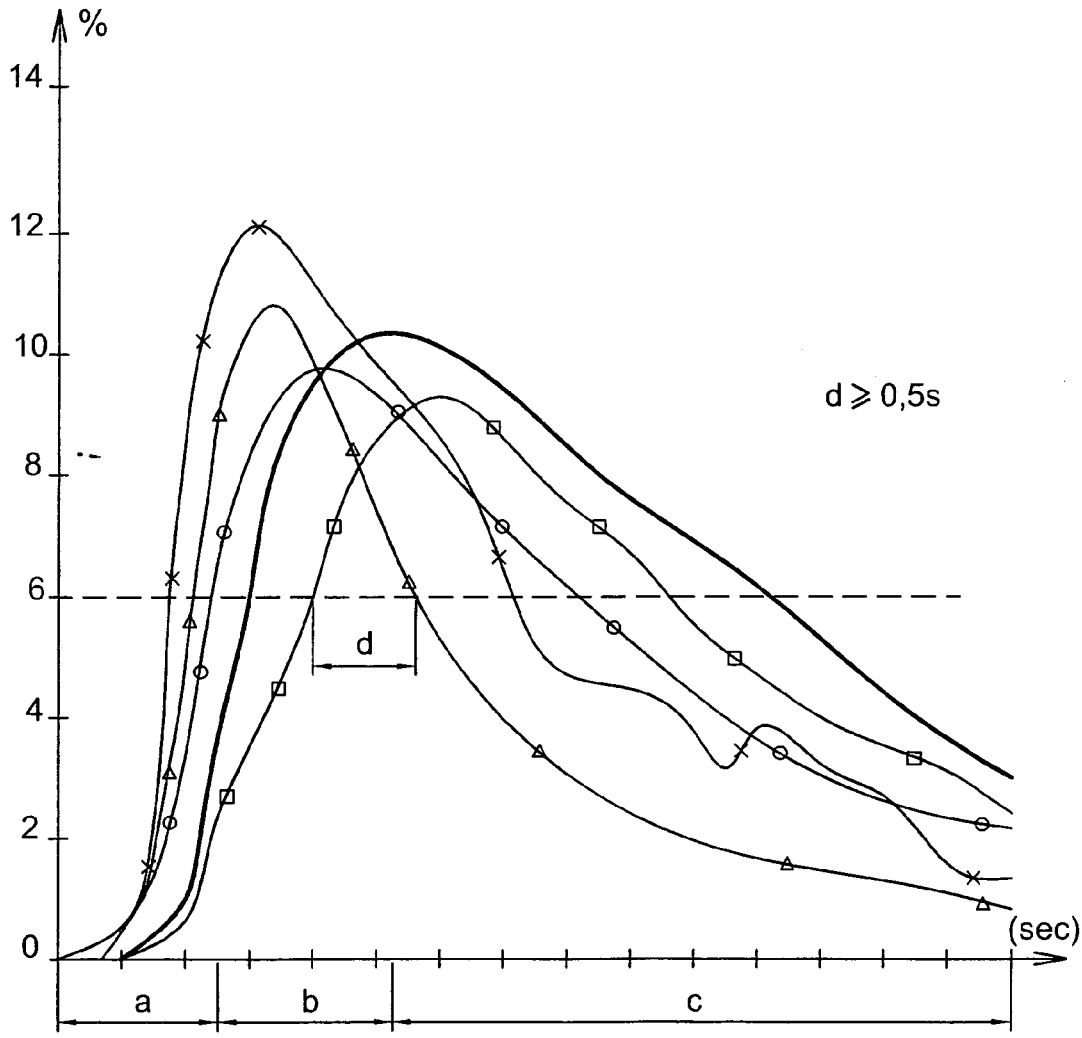
FIG. 1, described above, shows curves of the concentration of extinguishing agent at different points in the same fire area for a conventional pressurised extinguisher.
Figure 2:
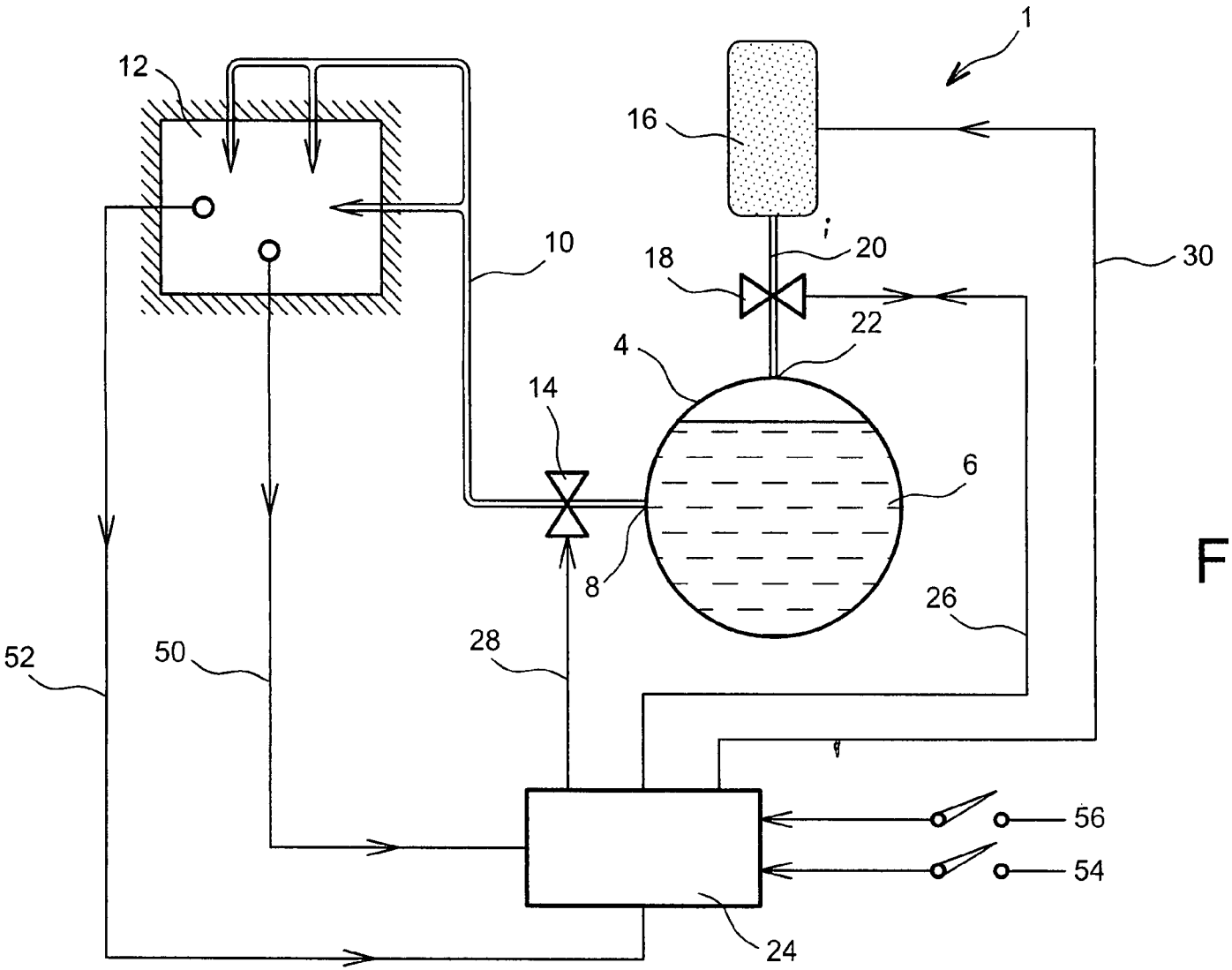
FIG. 2 shows an extinguishing device according to one embodiment of the invention.

As shown in FIG. 2, the extinguishing device or the extinguisher 1 comprises a bottle 4, for example a spherical bottle, used as the extinguishing agent tank. The bottle 4 is preferably at ambient pressure; the extinguishing agent 6 may be a liquid: precise control of pressurisation described below while the extinguishing agent is being ejected outside the bottle 4 enables the use of new extinguishing agents that are difficult to atomise, for example with very low saturating vapour pressure (like solvents) that are more in the liquid state, particularly within the temperature range involved in the aeronautical application.

The bottle 4 comprises one or several output orifices 8 that may be coupled to distribution pipes 10, so as to enable ejection of the extinguishing agent 6 towards an area to be treated 12. Preferably, the output orifices 8 are located on the side on which the extinguishing agent 6 accumulates, in other words usually towards the bottom of the bottle 4. Advantageously, each output orifice 8 is closed by a closing device 14 in order to keep the extinguishing agent in the bottle 4 as long as its action is not being required. In particular, if the orifice 8 is a single orifice, the closing device 14 may for example be a tared shutter, in other words a membrane that breaks or opens as soon as the pressure inside the bottle 4 reaches a certain threshold. The closing device 14 may also be a valve, advantageously remote controlled, either by manual control or by a control mechanism coupled for example to means of pressurising the bottle 4. Other closing devices 14 are known, for example in documents WO 93/25950 or U.S. Pat. No. 4,877,051 and are commercially available.

Furthermore, the extinguishing device 1 comprises means of generating a pressurised gas 16 coupled to means 18 of regulating the pressure in the bottle 4. The means 16 of generating a pressurised gas are connected to the extinguishing agent bottle 4 through a pipe 20 and an opening 22 on the bottle 4. Advantageously, the opening 22 of the communication pipe or passageway 20 between the extinguishing agent tank 4 and the pressurised gas generation means 16 is located opposite the output orifice 8.

In one embodiment of the invention illustrated in FIG. 2, the means 16 of generating a pressurised gas may consist of a pressurised gas tank. In this case, it is advantageous to use a valve located in the pipe 20 as the means 18 of regulating the pressure in the bottle 4. The valve may be predefined so as to provide a gas flow in the pipe 20 such that the pressure inside the bottle 4 follows a predetermined profile. For example, its opening diameter may depend directly on the pressure in the bottle 4. The pressure in the bottle 4 depends directly on its contents of pressurised gas; if the dimensions of the bottle 4 and the instantaneous ejection flow of gas with the extinguishing agent coupled to the output orifice 8 is known, it is easy to produce a model for the law for the pressure existing inside the bottle 4 as a function of the input gas flow.

Preferably, the valve 18 is connected to a control device 24 that modifies the parameters, either manually or as a function of measured controls (see below), to open and/or close the valve 18 through a control line 26. The discharge of the extinguishing agent can also be controlled as a function of the measurement of its concentration in the fire area 12. In this case, the devices 18 and 24 can be controlled simultaneously.

The control line 26 may also be used "in the other direction" so as to use flow parameters in the communication pipe 20 and/or pressure parameters in the bottle 4 to control other functions of the extinguishing device 1. For example, in reaction to a signal output from the valve 18, the control system 24 may control opening of the valve 14 located on the distribution pipe 10 through the control line 28, so as to delay it until a minimum pressure is reached in the bottle 4, or to control its opening parameters so as to adapt them to this pressure and thus achieve a constant concentration of extinguishing agent 6 in the fire area 12. Another possible method of making the regulation according to the invention is to make a regulation control 30 directly on the means 16 of generating a pressurised gas. For example, if gas is compressed mechanically on demand in a tank 16, it is possible to act on the mechanical parameters so as to increase or reduce the pressure generated in the tank 16, and thus modify the pressure inside the bottle 4. In this case, the valve 18 located on the communication pipe 20 may be simplified so that it can then have only two positions, namely open and closed.

Figure 3:
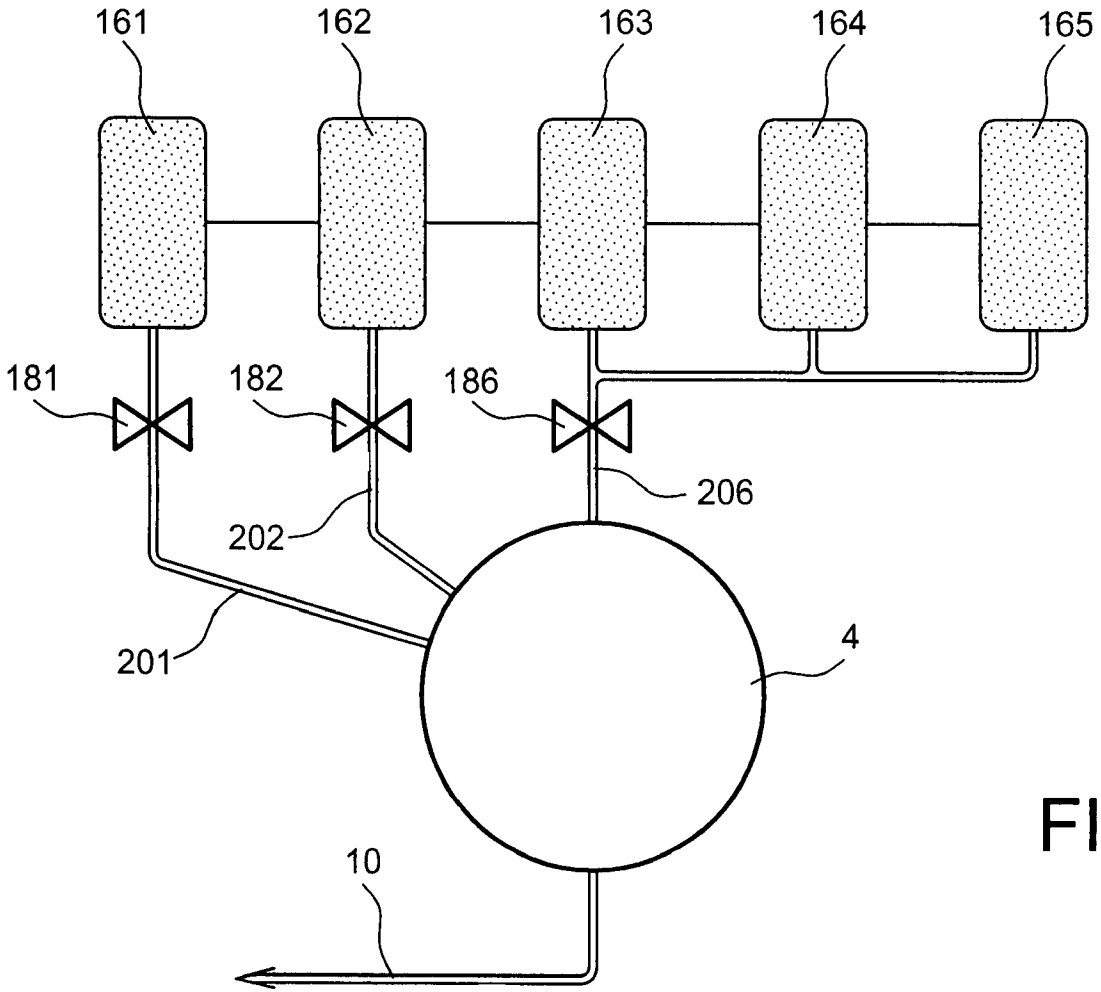
FIG. 3 shows an alternate extinguishing device according to the invention.

Another embodiment relates to the presence of several pressurised gas tanks as a means of generating a pressurised gas in the extinguishing agent bottle 4; see FIG. 3. In this case, it is possible that each tank 161, 162 can be put into communication with the bottle 4 through its own pipe 201, 202 provided with its regulation valve 181, 182. It is also possible to provide a single valve 186 located on a pipe 206 leading to the bottle 4 and to several tanks 163, 164, 165 coupled to each other.

Those skilled in the art will clearly see that these examples are illustrative; other means could be used according to the principle of the invention to generate a pressurised gas so as to eject the extinguishing agent. It would be possible to use chemical reactions, for example by mixing products, or pumps compressing a gas collected from the near or far environment of said device.

Figure 4:
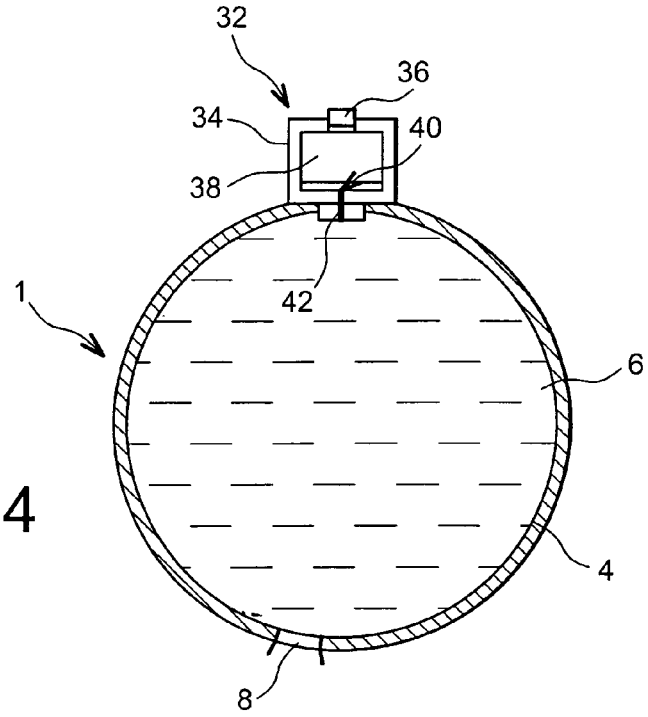
FIG. 4 shows another embodiment of the extinguisher according to the invention.

Another embodiment thus relates to a gas generator 32 with a pyrotechnic cartridge. Advantageously, and as illustrated in FIG. 4, the generator is outside the bottle 4; it consists of a chamber 34 provided with an ignition device 36, and containing a cartridge 38 made of a pyrotechnic material such as a propellant. Gases generated by the combustion of the pyrotechnic material are directed to the bottle 4 through the output orifice 40 of the chamber 34. Advantageously, the output orifice 40 is provided with a nozzle 42, if possible conformed so that the speed of sound is reached at least at the section of the nozzle 42, which provides isolation of the gas generator 32 from the bottle 4 and therefore does not disturb combustion of the pyrotechnic material 38 (if there is no nozzle, the pressure is exactly the same in the bottle 4 and in the generator 32).

With a device of this type, the block of combustible material 38 can be calibrated such that a determined gas flow can be output from the chamber 34 through the opening 40; the pressure regulation means are then integrated directly in the pressurised gas generator 32, and a single control on the ignition device 36, for example by a system similar to that described in FIG. 2, provides a means of controlling the pressure inside the bottle and therefore at the output 8 from the extinguisher 1; thus the concentration of extinguishing agent on the fire area 12 may follow the predetermined profile.

Different formulas are used to connect the different parameters (pressure, velocity and combustion area, generated gas flow, etc.) together, so as to optimise the geometry of the block of combustible material, the chamber and the initial conditions for a pyrotechnic material so as to achieve the required result and flow. Thus the gas flow generated by combustion of a pyrotechnic material 38 such as a propellant is:

$$Q=\rho S_c V_c \tag{2}$$

where

Q: flow (kg/s), $\rho$: propellant density (kg/m$^3$), $S_c$: combustion surface area of propellant (m$^2$), $V_c$: combustion velocity of propellant (m/s).

Furthermore, the combustion velocity of the propellant $V_c$ depends on the pressure in the combustion chamber, also called the Pitot pressure, namely:

$$V_c=aP^n \tag{3}$$

where a, n: experimentally determined coefficients dependent on the propellant composition, P: Pitot pressure (Pa).

The gas flow passing through a nozzle is expressed as follows:

$$Q = \frac{PA_t}{C_{et}} \quad (4)$$

where

P: Pitot pressure (Pa), $A_t$: surface area at the nozzle neck ($m^2$), $1/C_{et}$: flow coefficient, that depends on the nature of the gas (s/m).

The flow Q of the gas generated by combustion of the material can be controlled simply by solving these equations using an iterative solution as a function of the intrinsic characteristics of the chosen propellant (ρ, a, n, $C_{et}$) and ejection conditions of the inert gas ($A_t$, P, $V_c$).

The Flow Control Q then Assures Control Over the pressure existing in the bottle 4 as it'varies with time and the flow.

Figure 5:
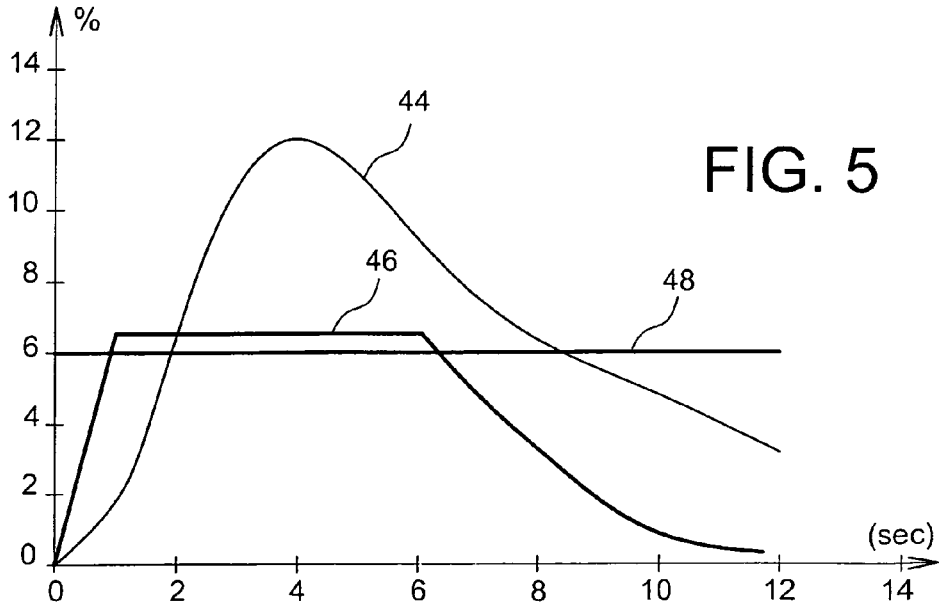
FIG. 5 shows a curve of the concentration of extinguishing agent at a point in the area of a fire with a known extinguisher and with an extinguisher according to the invention.

In particular, it is desirable to have an optimum concentration of extinguishing agent 6 in the fire area 12. FIG. 5 shows an example embodiment of a curve representing the extinguishing agent concentration at the outlet from the extinguisher 1 according to the invention. Curve 44 shows the concentration of extinguishing agent at a point in a fire area 12 according to prior art, while the curve 46 shows the concentration of extinguishing agent at the same point in a fire area with a device according to the invention, for which the flow law is chosen to be a "step" function, in other words a flow that is practically constant during ejection of the pressurised extinguishing agent (namely during the combustion of the pyrotechnic block if this solution is adopted), except for starting and stopping phases. The limit 48 corresponds to criteria according to the regulations in force in aeronautics. As can be seen in this figure, the pressure in the bottle can be managed so as to achieve a constant concentration for a defined time period, or a variable concentration as a function of needs in the fire area considered. Consequently, the device according to the invention can be used to create square concentration steps (or other shapes if required), which improves the extinguishing capacity by increasing the time during which the concentration threshold of the extinguishing agent necessary for extinguishing the fire is exceeded simultaneously and/or reducing the mass of extinguishing agent to be carried onboard for the same required extinguishing efficiency.

In particular, the predetermined pressure profile obtained due to regulation according to the invention may be such that the pressure is practically constant in the tank for a given duration normally exceeding 2 s, in other words that the pressure does not vary by more than 10%, and preferably varies by less than 5%, or even 2% of the nominal value. At this pressure, a linear or "flattened" Gaussian shaped pressure profile, may be adopted.

The duration of the general regulation profile may be longer than this step, for example of the order of 6 s. Thus, during the period concerned by regulation, it is for example possible to consider different concentration thresholds in the fire area, and thus have a series of pressure steps, or a flattened Gaussian pressure followed by a controlled linear decay.

Example

In the context of this example, the extinguishing agent 6 is considered to have characteristics similar to the characteristics of halon. In particular, its saturating vapour pressure is such that due to pressurisation, it is in the liquid state and is assumed to be incompressible in the bottle 4 and in the supply pipe 10 at the ejection nozzle. On the downstream side, it is atomised and then vaporises in the fire area 12.

Due to the pressure regulation means, a first phase (called "booster") can be defined during which the time necessary to reach a concentration of extinguishing agent in the fire area 12 concerned that is equal to or greater than the time necessary for extinguishing is fixed. In this first phase, it is known that the concentration at time t=0 is zero, hence:

$$C_1(t) = \frac{Q_i}{Q_r + Q_i}\left(1 - \exp\left(-\left(\frac{Q_r + Q_i}{V}\right)t\right)\right) \quad (1)$$

If pressure losses in the pipe 10 between the bottle 4 and the fire area 12 are neglected, the result is an instantaneous flow $Q_i$ in the fire area 12:

$$Q_{i1} = K_b \cdot K_b \cdot S_b \cdot (2\rho_1 \cdot (P_i - P_a))^{0.5}$$

where:

$K_b$: flow coefficient of the ejection nozzle 10, $S_b$: passage area of this same ejection nozzle, $\rho_i$: density of the extinguishing agent 6 in the liquid phase, $P_i$: pressure existing in the bottle 4, $P_a$: pressure existing in the fire area 12.

After this phase, it is desirable to keep the concentration in the fire area at a level close to that achieved at the end of the first phase, in the "sustainer" phase. The result is then:

$$C_2(t) = \left(C_{max} - \frac{Q_i}{Q_r + Q_i}\right) \cdot \exp\left(-\left(\frac{Q_r + Q_i}{V}\right)t\right) + \frac{Q_i}{Q_r + Q_i} = cte \quad (1)$$

which leads to $$Q_{i2} = C_{max} \cdot \frac{Q_r}{1 - C_{max}}$$

In particular:

consider an 8-liter bottle 4 at a pressure of 50 bars before the ejection orifice 8 is opened (with an ejection nozzle 10 with characteristics $K_b$=0.85 and $S_b$=9.8×10$^{-6}$ $m^2$), for which the extinguishing agent 6 has a density $\rho_1$=1538 kg/$m^3$ in the liquid phase and $\rho_g$=6.647 kg/$m^3$ in the gaseous phase, take action on a fire area with a volume V=5.04 $m^3$ at pressure $P_a$=1 atm, with an air refreshment $Q_r$=0.59 $m^3$/s, it is chosen to reach the quantity $C_{max}$ equal to 7% after 2.8 seconds;

the result is a flow in the fire area 12 during the first phase equal to $Q_{i1}$=1.023 kg/s namely 0.665 l/s of liquid extinguishing agent output from the bottle; in the second phase, the flow is $Q_{i2}$=0.29 kg/s namely 0.19 l/s of liquid output from the bottle, which imposes a pressure in the bottle equal to 4.94 bars.

As mentioned above, the gas necessary for pressurisation of the bottle may be stored in a pressurised chamber 16 with a flow regulation device installed between this chamber and the bottle 4. A pyrotechnic gas generator 32 can also be used. The calculations will be done with a propellant, chosen for illustrative purposes only and in no way limitative, with the following characteristics:

$C_{et}$=1034 m/s $\rho$=1600 kg/m$^3$
a=1.7×10$^{-6}$
n=0.5
gaseous yield of gas generated per mass burned: 1.2 l/g.

Therefore the required flow is equal to $Q_{i1}$=0.665 l/s during the first phase, which is an output gas flow from the generator equal to $$Q = \frac{50 \times 0.665}{1.2} = 27g/s = 0.027kg/s.$$

The combustion velocity in the chamber and therefore the thickness to be burned $E_p$ for the first 2.8 seconds during the first phase and during which an attempt is made to keep the pressure P equal to the order of 50 bars is:

$$V_c = 1.7\times10^{-6}\times(5\times10^5)^{0.5} = 3.8\times10^{-3}\ \text{m/s}$$

$$E_p = 2.8\times V_c = 10.6\ \text{mm} \quad (3)$$

This is equivalent to a combustion area:

$$S_c = \frac{Q}{\rho \times V_c} = 4440\ \text{mm}^2. \quad (2)$$

The flow during the second phase is $Q_{i2}$=0.19 for $P_i$=4.94. Therefore the generator flow is Q=0.19×4.94=0.94 l/s=0.78×10$^{-3}$ kg/s, which gives a combustion surface area $S_c$=406 mm$^2$ for 3.4 seconds.

The surface areas (4440 and 406 mm$^2$) may be obtained in several ways, with blocks burning on a single face (like a "cigarette") or on several faces, each face possibly being partially inhibited, etc. The required shape of the block depends on manufacturing conditions, the variation of the surface area, and also the ignition mode (for example at one side or on a surface). The variation of the combustion surface area with time can be optimised to obtain a flow law as required.

One example embodiment of the block 60 is illustrated in FIG. 6A. The combustion surface area for the "booster" phase is a circular face 62 with a radius R; the required flow for the "sustainer" phase is much smaller, and the combustion surface area is limited to a ring 64 with an outside radius R and thickness E. Combustion of this propellant ring only begins when the solid face 62 with radius R has already been consumed (the block 60 burns like a cigarette from left to right, except for inhibited surfaces 66). Assuming R=37.6 mm and E=2 mm, the result is appropriate combustion surfaces with the thickness to be burned $E_p$=10.6 mm.

For the second phase, the thickness to be burned (in the axial direction) is equal to at least the combustion time multiplied by the combustion velocity at the operating pressure, namely $E_{p2}$=4.1 mm. This thickness can be increased if the mechanical behaviour of the propellant block 60 makes it necessary; at this moment, the bottle 4 is at the end of the emptying stage and the combustion duration can be extended without any penalty except for the mass of propellant.

As can be seen in FIG. 6B, the large combustion area of the propellant block in the "booster" phase quickly results in generation of sufficient gas to increase the pressure in the bottle up to 50 bars. At this pressure, the volume of the extinguishing agent output from the bottle (after the shutter breaks) is just balanced by the incoming volume of gas generated by combustion of the block, and therefore the pressure stabilises at 50 bars and the agent flow also stabilises and remains constant. This flow of extinguishing agent causes a fast increase in the concentration C of extinguishing agent in the fire area, until the required maximum of 7% is achieved.

At this moment, the variation of the combustion of block 60 is such that the combustion surface area is reduced to the annular area 64. The gas flow is no longer sufficient to maintain a pressure of 50 bars in the bottle and a new equilibrium condition is set up between the incoming gas volume and the outgoing gas volume at a pressure of about 5 bars. At this pressure, the flow of agent is such that the concentration of agent in the fire area remains constant (or practically constant) at the level reached at the end of the first phase, namely 7%.

The end of the "sustainer" phase is reached when the bottle containing the agent is empty. The next phase is called the "renewal" phase in which the concentration of extinguishing agent quickly drops, while the area is ventilated.

Note that two different propellants could also be used for the two combustion phases, so that there can be an additional degree of freedom on the combustion surface.

These parameters are calculated for guidance, and it is obvious that modifications can be made. Those skilled in the art will find it easy to determine the different possible methods of satisfying their requirements as closely as possible, and particularly such that the pressure inside the bottle 4 follows the ideal profile of the concentration of the extinguishing agent for the planned use.

In particular, more than two phases may be required depending on the application. For example for a fire area with volume V=4.39 m$^3$ fairly strongly ventilated with an air renewal flow $Q_r$=2.99 m$^3$/s, a "booster" phase similar to the above will be required. It will also be required to keep this concentration for a first "sustainer 1" phase with a duration of 3 s, and then to do another step in a "sustainer 2" phase with a duration of 2.9 s at a concentration of 6%, until the bottle has been completely emptied.

The calculations are made in exactly the same way as for the previous example with different numeric values, and the results are:

"booster" phase: agent flow=1.728 kg/s at a pressure of 50 bars, leading to a combustion area of 7695 mm$^2$ with the characteristics given above;

"sustainer 1" phase: agent flow=1.497 kg/s at a pressure of 37.8 bars which gives a combustion area of 5795 mm$^2$;

"sustainer 2" phase: agent flow=1.2 kg/s at a pressure of 27.4 bars, which gives a combustion area of 4186 mm$^2$.

One potential form of the propellant block 70 enabling operation as specified is given in FIG. 7A, the block burning like a cigarette from left to right, except for inhibited areas 72; the concentration profile thus obtained with the use of such a block is illustrated in FIG. 7B. The lengths are as follows:

| | |
|---|---|
| R = 49.5 mm | $E_p$ = 10.6 mm |
| $R_1$ = 24.6 mm | $E_{p1}$ = 9.9 mm |
| $R_2$ = 33.4 mm | $E_{p2}$ ≧ 8.1 mm |

Moreover and as shown in FIG. 2, means could be provided of detecting the concentration of extinguishing agent 6 on the fire area 12 in real time, for example by the presence of a sensor located in the fire area 12 or on the pipe 10. The controller 24 can use the detected concentration 50 to have finer control over the pressure inside the bottle and/or opening of the ejection valve 14.

Other parameters could be used to control the pressure regulation means 18 inside the bottle. For example, a signal 52 output from a fire detector could be used as a trigger to open communication means 20 between the pressurised tank 16 and the extinguishing bottle, or as a trigger for an ignition mechanism 36 in the case of a gas generator 32. It might be preferable to provide a neutralisation device 54 for the controller 24. It may also be useful to provide a manual trigger device 56 on the control box 24 and/or the pressure regulation means 18.

Obviously, the description given above does not mention all alternatives that those skilled in the art will no doubt want to use to make an object according to the invention. In particular, various combinations of the different embodiments presented are possible. Furthermore, although the means 24 of controlling the various mechanisms are centralised in this presentation, it is quite obvious that it would be possible to have separate controls for each sensor and/or device to be controlled, instead of a single control box.

The invention claimed is:

1. A fire extinguishing device comprising:

an extinguishing agent tank containing an inlet, an outlet, and an extinguishing agent;

pressurized gas generation means for generating a pressurized gas; and communication means connected to a controller that controls a means for regulating a pressure created by the gas in a communicating passageway between the inlet of the extinguishing agent tank and the pressurized gas generation means, such that the pressurized gas generated by the pressurized gas generation means penetrates into the extinguishing agent tank;

wherein the controller controls a means for closing the outlet of the extinguishing agent tank to prevent extinguishing within the extinguishing agent tank when not in use, wherein the means for regulating a pressure holds the pressure in the extinguishing agent tank not varying from a nominal value by more than 10% for a given first duration while the extinguishing agent is being ejected outside said extinguishing agent tank, and wherein the inlet of the extinguishing tank is located in an upper portion of the tank for input of the pressurized gas.

2. A device according to claim 1, wherein the pressure in the extinguishing agent tank, when there is no gas in the extinguishing agent tank from the pressurized gas generation means, is ambient pressure.

3. A device according to claim 2, wherein the extinguishing agent is in liquid form.

4. A device according to claim 1, wherein the means for regulating are capable of holding a pressure varying by not more than 5% from a nominal value inside the extinguishing agent tank for at least 2 seconds.

5. A device according to claim 1, wherein the means for regulating holds the pressure in the extinguishing agent tank not varying from a nominal value by more than 10% according to a predetermined profile for a second duration at a pressure different from the pressure of the first duration.

6. A device according to claim 1, wherein the pressurized gas generation means comprise at least one pressurized gas tank and the means for regulating the pressure comprise a flow regulation valve between the pressurized gas tank and the extinguishing agent tank.

7. A device according to claim 6, comprising a plurality of pressurized gas tanks.

8. A device according to claim 7, comprising a plurality of flow regulation valves between the extinguishing agent tank and at least one pressurized gas tank.

9. A device according to claim 1, wherein the controller controls the means for regulating as a function of control parameters.

10. A device according to claim 9, wherein the controller comprises a sensor for measuring the concentration of the extinguishing agent in the area to be treated and said concentration is one of the control parameters.

11. A device according to claim 9, wherein the controller comprises a device for detecting a fire, and said detection is one of the control parameters.

12. A device according to claim 9, wherein the controller comprises a manual triggering device, and manual triggering is one of the control parameters.

13. A device according to claim 9, wherein the controller comprises a neutralization device.

14. A device according to claim 9, further comprising a distribution network, controlled by the controller.

15. A fire extinguishing device comprising:

an extinguishing agent tank containing an inlet, an outlet, and an extinguishing agent;

at least one pressurized gas tank;

a communication pipe providing a communicating passageway between the inlet of the extinguishing agent tank and the pressurized gas tank, such that the gas provided by the pressurized gas tank penetrates into the extinguishing agent tank;

a means for closing the outlet of the extinguishing agent tank to prevent extinguishing within the extinguishing agent tank when not in use; and at least one flow regulation valve between the pressurized gas tank and the extinguishing agent tank, which regulates the pressure created by a gas that penetrated in the inlet of the extinguishing agent tank so that the pressure in the extinguishing agent tank does not vary from a nominal value by more than 10% for a given first duration while the extinguishing agent is being ejected outside said extinguishing agent tank and the pressure in the extinguishing agent tank is held not varying from a nominal value by more than 10% according to a predetermined profile for a second duration at a pressure different from the pressure of the first duration, wherein the means for closing the outlet of the extinguishing agent tank and the at least one flow regulation valve are in communication with a controller that controls control parameters of the tank.

16. A device according to claim 15, wherein said flow regulation valve regulates said pressure inside said extinguishing agent tank so as to provide a substantially constant flow of said extinguishing agent from said extinguishing agent tank during an ejection of said extinguishing agent from said extinguishing agent tank, wherein said ejection with said substantially constant flow is immediately preceded by a starting phase of increasing flow and is immediately followed by a stopping phase of decreasing flow.

17. A device according to claim 16, wherein said substantially constant flow is predetermined and above a level required by aeronautics regulations.

18. A device according to claim 15, further comprising an output valve, said extinguishing agent being ejected through said output valve.

19. A device according to claim 18, wherein the controller controls said flow regulation valve while said output valve is open.

20. A device according to claim 19, wherein said controller controls said output valve as a function of opening parameters of said flow regulation valve.

21. A fire extinguishing device comprising:

an extinguishing agent tank containing an inlet, an outlet, and an extinguishing agent;

at least one pressurized gas tank;

a communication pipe between the inlet of the extinguishing agent tank and the pressurized gas tank, such that the gas provided by the pressurized gas tank penetrates into the extinguishing agent tank;

at least one flow regulation valve between the pressurized gas tank and the extinguishing agent tank, which regulates the pressure created by the gas the penetrated in the extinguishing agent tank so that the pressure in the extinguishing agent tank does not vary from a nominal value by more than 10% for a given first duration while the extinguishing agent is being ejected outside said extinguishing agent tank;

a closing valve that closes the outlet of the extinguishing agent tank to prevent extinguishing within the extinguishing agent tank when not in use; and a controller that controls the flow regulation valve and the closing valve as a function of control parameters, wherein the inlet of the extinguishing tank is in a portion thereof of the tank not containing the extinguishing agent for input of the pressurized gas.

22. A device according to one of claim 1, 15 or 21, further comprising a distribution network of the extinguishing agent.

23. A device according to claim 22, wherein the distribution network comprises a tared shutter.

24. A device according to claim 21, wherein the at least one flow regulating valve holds the pressure in the extinguishing agent tank not varying from a nominal value by more than 10% according to a predetermined profile for a second duration at a pressure different from the pressure of the first duration.

25. A fire extinguishing device comprising:

an extinguishing agent tank containing an inlet, an outlet, and an extinguishing agent;

pressurized gas generation means for generating pressurized gas;

communication means connected to and for controlling a means for regulating a pressure created by the gas in a communicating passageway between the extinguishing agent tank and the pressurized gas generation means, such that the gas generated by the pressurized gas generation means penetrates into the inlet of the extinguishing agent tank;

means for regulating a pressure created by the gas that holds the pressure in the extinguishing agent tank not varying from a nominal value by more than 10% for a given first duration while the extinguishing agent is being ejected outside said extinguishing agent tank;

means for closing the outlet of the extinguishing agent tank to prevent extinguishing within the extinguishing agent tank when not in use;

a distribution network;

a sensor for measuring a concentration of the extinguishing agent in an area to be treated;

a device for detecting a fire;

a manual triggering device;

a neutralization device; and a controller that controls the means for regulating, the means for closing, and the distribution network as a function of said concentration, a detection from said device for detecting and/or a manual triggering from said manual triggering device, wherein the inlet of the extinguishing tank is in an upper portion of the tank not containing the extinguishing agent for input of the pressurized gas.

26. A device according to claim 1, wherein said means for regulating includes flow means for providing a substantially constant flow of said extinguishing agent from said extinguishing agent tank during an ejection of said extinguishing agent from said extinguishing agent tank, wherein said ejection with said substantially constant flow is immediately preceded by a starting phase of increasing flow and is immediately followed by a stopping phase of decreasing flow.

27. A device according to claim 26, wherein said substantially constant flow is predetermined and above a level required by aeronautics regulations.

28. A device according to claim 25, wherein the means for regulating holds the pressure in the extinguishing agent tank not varying from a nominal value by more than 10% according to a predetermined profile for a second duration at a pressure different from the pressure of the first duration.

* * * * *